US009453635B1

(12) United States Patent
Fuller et al.

(10) Patent No.: US 9,453,635 B1
(45) Date of Patent: Sep. 27, 2016

(54) LIGHTING MODULES

(71) Applicant: WET, Sun Valley, CA (US)

(72) Inventors: Mark W. Fuller, Studio City, CA (US); John Canavan, Burbank, CA (US)

(73) Assignee: WET, Sun Valley, CA (US)

( * ) Notice: Subject to any disclaimer, the term of this patent is extended or adjusted under 35 U.S.C. 154(b) by 145 days.

(21) Appl. No.: 13/682,200

(22) Filed: Nov. 20, 2012

Related U.S. Application Data

(60) Provisional application No. 61/562,253, filed on Nov. 21, 2011.

(51) Int. Cl.
*F21V 21/00* (2006.01)

(52) U.S. Cl.
CPC ..... *F21V 21/00* (2013.01)

(58) Field of Classification Search
CPC ..... F21K 9/1375; F21V 14/02
See application file for complete search history.

(56) References Cited

U.S. PATENT DOCUMENTS 6,390,643 B1 * 5/2002 Knight ..... 362/249.03
7,607,802 B2 * 10/2009 Kang et al. ..... 362/294
8,013,347 B2 * 9/2011 Zhang et al. ..... 257/88
2008/0013334 A1 * 1/2008 Lu et al. ..... 362/545
2012/0120661 A1 * 5/2012 Uemoto et al. ..... 362/249.03

OTHER PUBLICATIONS

Philips Lumileds Lighting Company, "Luxeon Rebel ES", (2011), 35 pp. total.

* cited by examiner

*Primary Examiner* — Elmito Breval
(74) *Attorney, Agent, or Firm* — Maceiko IP

(57) ABSTRACT

Lighting modules having a first LED support having a first plurality of LEDs mounted thereon adjacent a center of the first LED support, a second LED support having an outer edge and an inner opening, and a second plurality of LEDs mounted thereon adjacent the inner opening of the second LED support, the second LED support being spaced apart from the first LED support, the inner opening of the second LED support being larger than the region of the first LED support having the first plurality of LEDs, whereby light from the LEDs on the first LED support may pass though the inner opening of the second LED support. Additional larger LED supports with LEDs may be added, and the assembly of the LED supports sealed with the outer edges of the LED supports extending outward for immersion and cooling in water when incorporated in a larger sealed assembly.

24 Claims, 5 Drawing Sheets

LIGHTING MODULES

CROSS-REFERENCE TO RELATED APPLICATIONS

This application claims the benefit of U.S. Provisional Patent Application No. 61/562,253 filed Nov. 21, 2011.

BACKGROUND OF THE INVENTION

1. Field of the Invention

The present invention relates to the field of underwater lighting.

2. Prior Art

The preferred embodiments of the present invention are intended for use in underwater lighting, though as shall be subsequently described, are not so limited. Underwater lighting is commonly used for purposes ranging from swimming pool lighting to multicolor lighting for elaborate and animated water displays. Typically in the prior art incandescent bulbs are used in such applications, with color filters providing the desired color or color wheels providing the desired limited color variations when color is desired.

Incandescent bulbs in underwater lighting tend to have certain disadvantages. In particular, they are not particularly efficient and accordingly give off a lot of heat which must be dissipated. High power incandescent bulbs often require a higher voltage than one would like to use in underwater systems. Finally, incandescent bulbs have a limited life, and the failure of a single light in a sophisticated water display can detract from the overall visual appearance of the display. As a result, efforts have been made to adapt high power light emitting diodes (LEDs) to underwater use. For such purposes, each LED has been fitted with a reflector or refractive lens element to obtain the desired directional characteristics of the LEDs. Such a design, however, results in a large assembly for a given light intensity because of the required spacing of the LEDs to accommodate the reflectors or optical elements.

LED lighting has also been used with non-submersed applications for various lighting requirements. However such lighting tends to be granular in nature because the discreteness of the multiple sources of light in a multi-LED light fixture causes multiple shadows of an illuminated subject to be cast, resulting in a general "fuzzy" look to the lighting. Thus such lighting is generally of poor quality for such purposes as theatrical use, particularly when used to generate colored lighting, where colors are achieved by blending light from different color producing LEDs.

DETAILED DESCRIPTION OF THE PREFERRED EMBODIMENTS

Figure 1:
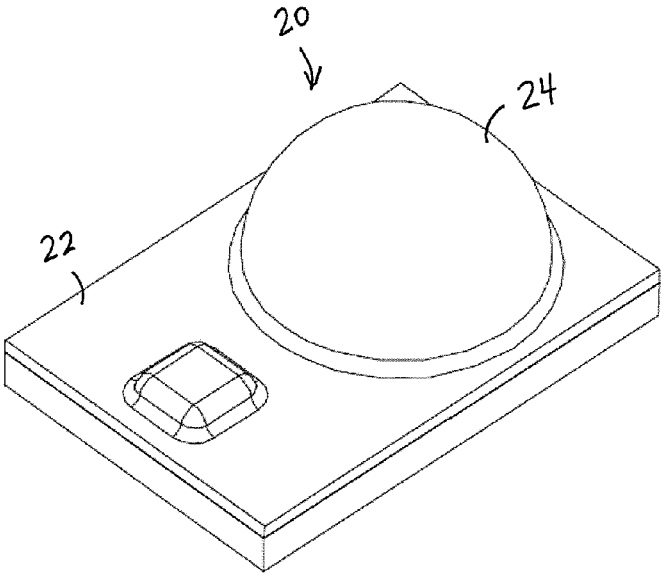
Fig. 1 (Prior Art)
FIG. 1 is a perspective top view of a typical LED that may be used with embodiments of the present invention.
Figure 2:
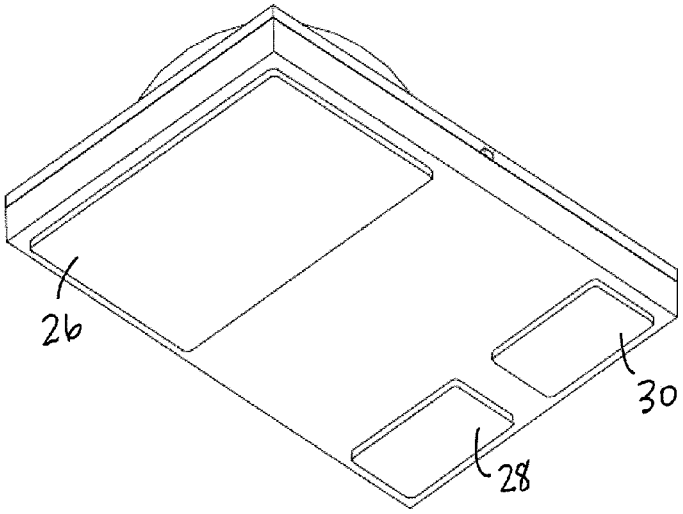
Fig. 2 (Prior Art)
FIG. 2 is a perspective bottom view of a typical LED that may be used with embodiments of the present invention.

First referring to FIGS. 1 and 2, a perspective top view and a perspective bottom view, respectively, of a typical LED that may be used with embodiments of the present invention may be seen. The particular LEDs used in the embodiments disclosed herein are Luxeon Rebel ES High Lumen LEDs, manufactured by Philips Lumileds Lighting Company, though other LEDs may be used. As may be seen in FIG. 1, each LED 20 has a rectangular footprint 22 with a lens 24 over the LED itself. In the bottom view of FIG. 2 may be seen a thermal pad 26 and anode and cathode regions 28 and 30. The thermal pad 26 is electrically isolated from the anode and cathode contact pads 28 and 30.

Figure 3:
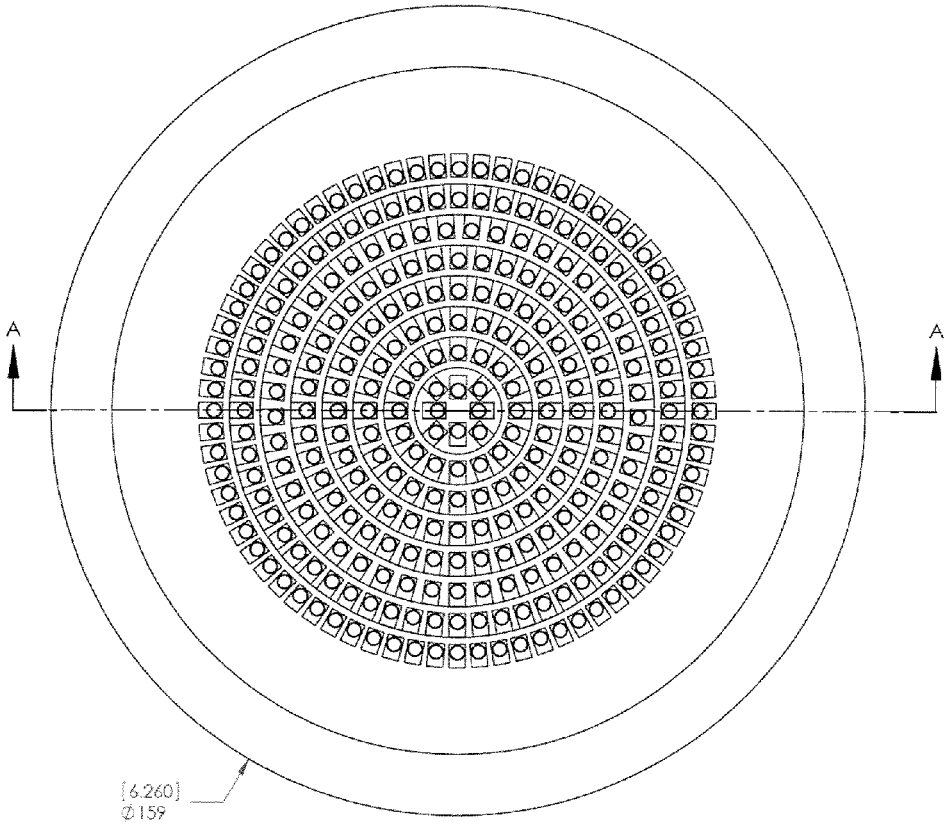
FIG. 3 is a face view of one embodiment of lighting module in accordance with the present invention.

In the embodiments of the present invention disclosed herein, 300 of the LEDs of FIGS. 1 and 2 are used in the lighting modules, a face view of one embodiment of which may be seen in FIG. 3. As may be seen therein, the 300 LEDs are arranged with 72 LEDs in an outer circle, 60 LEDs in the next circle, 48 LEDs in the third circle, 40 LEDs in the fourth circle, 32 LEDs in the fifth circle, 24 LEDs in the sixth circle, 16 LEDs in the seventh circle and 8 LEDs in the eighth or center circle. Note that with this arrangement each circle of LEDs has a plurality of 4 LEDs, with the LED colors being red, green, blue and white. Obviously if one wanted, different numbers of LEDs may be used in each circle, such as when using only three primary colors, red, green and blue, though preferably multiple LEDs of each color would be used in each circle to provide symmetry about the center of the lighting module for each color used. Similarly, the number of LEDs of each color may be different, such as to make up for any differences in intensity between the different colors, or to enable emphasizing one color, and the number of circles of LEDs may be changed (increased or decreased) to conveniently enable use of a different total number of LEDs. Also different combinations of different colors other than red, green, and blue (RGB) may be used to achieve various color blending results. In a preferred embodiment, the LEDs are arranged on all except LED support 48 (FIG. 4) in a circle having a radial extent (along a line from a central axis, whether the LED supports are round or of another shape) of one LED, though one could use a greater radial extent for each LED support if desired. However that does not package as well because of the planform of each LED as shown in FIGS. 1 and 2. Similarly the LED supports, openings therein and outer edges could be some shape other than round, such as, by way of example, square, hexagonal or octagonal, though circular is preferred, again for packaging reasons. For most efficient packaging, the openings in each LED support above the first is just adequate to allow the light from the LEDs on the lower LED supports to project through the respective opening, making all LEDs visible from the top as shown in FIG. 3.

Figure 4:
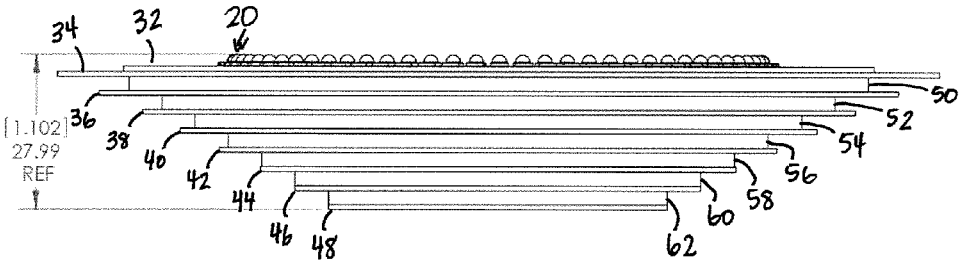
FIG. 4 is a side view of the assembly of FIG. 3.

Now referring to FIG. 4, a side view of the assembly of FIG. 3 may be seen. As shown therein, a top or outer ring of LEDs 20 may be seen, with the LEDs for this ring being mounted on a printed circuit board 32, which in turn is mounted on a LED support 34, preferably copper or other material having good thermal conductivity. Similar though smaller LED supports 36, 38, 40, 42, 44, 46 and 48 are stacked with spacers 50, 52, 54, 56, 58, 60 and 62 spacing respective pairs of the LED supports from each other. The spacers 50 through 62 are solid annular spacers, preferably metallic annular spacers to enhance heat transfer between LED supports to minimize both differential expansion and temperature gradients.

Figure 5:
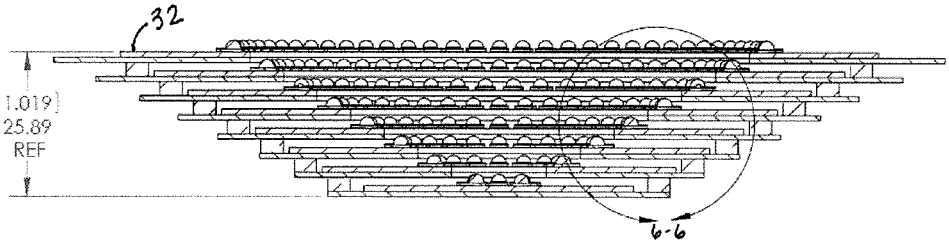
FIG. 5 is a cross section of the embodiment of FIG. 4.
Figure 6:
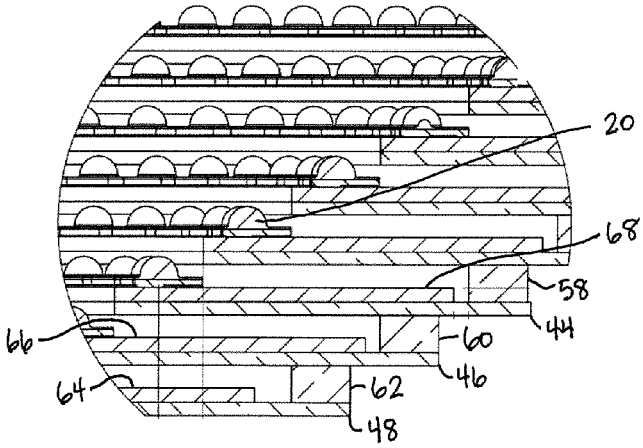
FIG. 6 is a portion of FIG. 5, taken on an expanded scale.

FIG. 5 presents a cross section of FIG. 4, with FIG. 6 showing a portion of FIG. 5 on an expanded scale taken along line 6-6 of FIG. 5. On each of circular LED supports 34 through 48 is a printed circuit board like the printed circuit board 32 of FIGS. 4 and 5, but of course proportioned in accordance with the diameter of that circle of LEDs and its respective LED support. In FIG. 5, only printed circuit board 32 is labeled, though some of the additional printed circuit boards, namely printed circuit boards 64, 66 and 68, are shown and labeled in FIG. 6. As may be seen, particularly for printed circuit board 68 on LED support 44, the printed circuit board 68 and LED support 44 have the same inner diameter, with the LEDs 20 mounted on the printed circuit board adjacent the inner edge thereof. In one embodiment the anode and cathode 26 and 28, as well as the thermal pad 24, are soldered (such as by solder reflow or similar techniques) to the respective printed circuit board.

Figure 7:
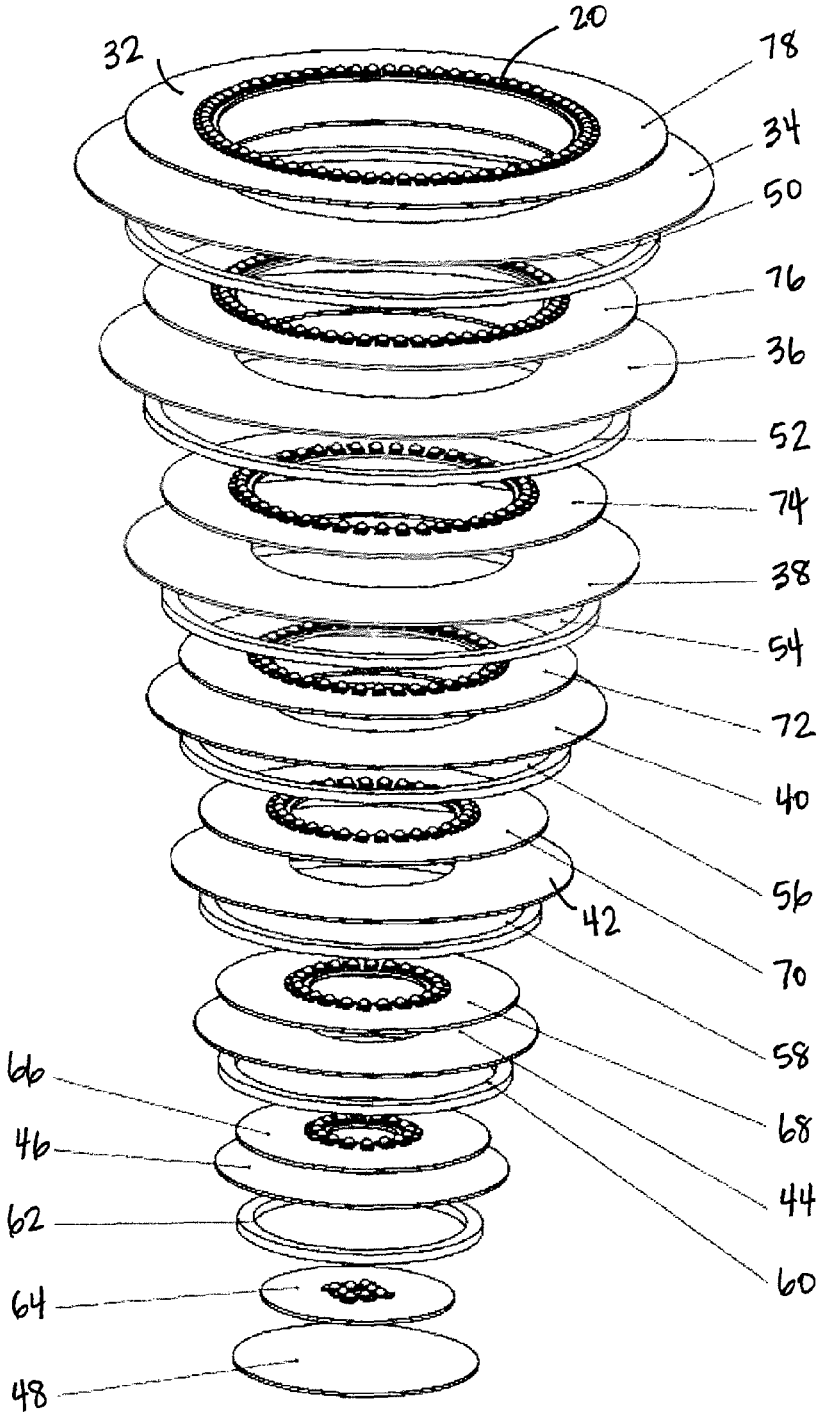
FIG. 7 is an exploded view of the embodiment of FIGS. 3-6.

Thus the entire assembly may be seen in the exploded view of FIG. 7. Here each of the LED supports 34 through 48 may be seen, as well as the printed circuit boards 64, 66 and 68 previously identified, as well as printed circuit boards 70, 72, 74, 76 and 32 with the LEDs 20 mounted thereon. Also visible, of course, are the spacers 50, 52, 54, 56, 58, 60 and 62. In one embodiment, this entire assembly is held together with an appropriate epoxy or otherwise fastened so that the module is one unitary sealed assembly that is open at the top. In use, the top LED support 34 would be joined to and sealed with respect to the rest of an optical system for concentrating the light to provide a much narrower beam than is created by the LED assembly of the present invention itself. Such a seal could be by way of epoxy, but preferably the seal is created by an O-ring or other seal between the top LED support 34 and the rest of the optical assembly, with bolts, screws or other removable or releasable fasteners holding the LED assembly and the rest of the optical system together so that either assembly may be separately serviced or replaced.

Accordingly when submerged in a fountain pool, the bottom of LED support 48 is in water, and at least an outer portion of each of the LED supports 34-46 will be submerged in water, so that the heat generated by the LEDs will be conducted out through the LED supports (copper or other good thermal conductor) to the surrounding water. Upward convection currents created by the heating of the surrounding water enhance the cooling obtained. For all LED supports, at least the bottom of the LED support will be exposed to the water, though in the embodiment shown in FIGS. 3-6, the upper LED supports 34, 36, 38, 40 and 42 extend outward beyond not only the LED support below, but also beyond where it is connected to the LED support above, so that both sides of the outer region of these LED supports will be exposed to the water. Further, it will be noted from FIG. 4 that for each such LED support, the radial extension increases with LED support diameter to compensate for the warmer water rising due to convection. Of course the LED supports could be square or other shape if desired, though round is preferred because of its compactness and packaging ease. In a non-submerged application the heat is transferred to the surrounding air.

Figure 8:
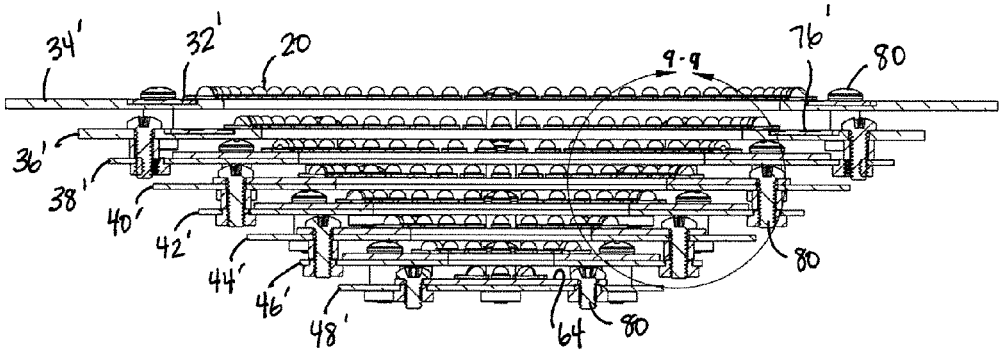
FIG. 8 is a cross section of an alternate embodiment of the present invention.
Figure 9:
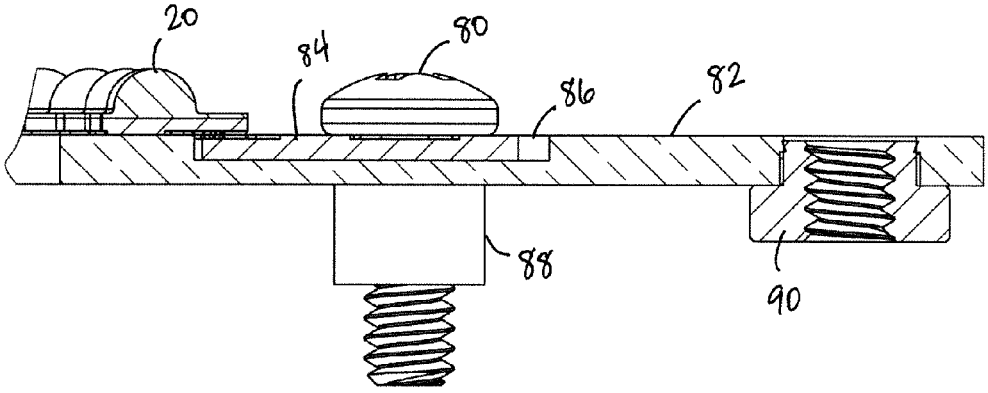
FIG. 9 is a cross section through one side of a LED support of the embodiment of FIG. 8.

Now referring to FIG. 8, a cross section of an alternate embodiment of the present invention may be seen. This embodiment includes certain features not in the earlier embodiment but which could be included in versions of the earlier embodiment, as desired. In particular, this embodiment is assembled and held together by screws 80 as may be seen in FIG. 8, and best seen in FIG. 9 which is a cross section through one side of LED support 82 whose function is similar to that of any of LED supports 36, 38, 40, 42, 44, 46 and 48 of the prior embodiment. Here, however, at least some of these LED supports have a screw 80 extending through the printed circuit board 84 which sits in a groove 86 in LED support 82 so as to have a top surface flush with the top surface of LED support 82, with the screw having a spacer ring 88 therebelow to function together with other similar spacers as the spacer rings of the prior embodiment. Also each LED support 82 has a nut member 90 pressed thereinto so as to be accessible from above, through which a similar screw 80 will be screwed to fasten the above larger LED support thereto. For the top LED support, the nut member 90 and hole therefor are not present, the provision for a connection to a larger optical assembly not being shown. Similarly, for the bottom LED support the nut member 90 is present, though the specific screw 80 and spacer ring 88 shown in FIG. 9, as well as the hole therefor through the printed circuit, are not present. Also in this embodiment it may be seen that because the upper surface of the printed circuit board is flush with the surface of LED support 82, each LED 20 can have its cathode and anode reflow soldered to the printed circuit board and the thermal pad reflow soldered or thermally epoxied to the LED support 82. Thus this embodiment has improved heat sinking for each LED and can be disassembled for replacement of any layer having a malfunction of any kind.

The embodiment of FIG. 8 has a number of advantages, though requires many more parts, more machining of the LED supports and much more manual assembly to achieve the final result. As shown in FIG. 8, it can be disassembled for repair, though only from the top down. However if screws 80 were turned over for the intermediate layers, then the stack could be split substantially anywhere to replace an individual layer without requiring full disassembly of the entire stack. In that regard, the first embodiment could have certain layers fastened together with screws rather than being cemented so that, by way of example, the top four LED supports or the bottom four LED supports could be replaced without having to replace the entire assembly. However sealing of the rings 50-62 to the LED supports 34-48 is more difficult, and seals tend to thermally insulate the rings from the LED support, decreasing the cooling obtained from the ring outer surface.

Since the present invention is the mechanical assembly for submersible lights, details of the electrical interconnections and electronic control of the LEDs has not been provided. Generally speaking, the printed circuit boards, which may be multi-layer boards, have adequate area for whatever electronics one desires to put on the boards, as opposed to providing such electronics in a separate package. Since there are 75 LEDs of each color in the exemplary embodiments, and each LED will draw approximately 700 milliamps at an excitation of 3 volts, the total current required will be approximately 50 amps per color. If the LEDs are driven even harder, of course the current will go up accordingly, with a maximum for the specific LEDs being used in the exemplary embodiments being 1 amp per LED, for a total of 75 amps for each color if the LEDs for each color are effectively in parallel. Power, and perhaps control, for those printed circuit boards that have a relatively large number of LEDs on them might be coupled to the respective printed circuit board at multiple locations around the board. By way of example, the top circuit board 32 has 72 LEDs on it, which at 700 ma, will take approximately 50 amps in the exemplary embodiment, and as much as 72 amps for maximum intensity. Accordingly currents to supply the printed circuit boards, at least those that require high currents, may be delivered directly to that circuit board in multiple angular locations on that board, so that large currents are not required to be conducted on the printed circuit boards themselves, and the decoding of the control signals and the drivers for the LEDs may also be distributed around the printed circuit boards. Of course other interconnections may also be used, if desired.

In general, the lighting module of the present invention will be placed within a single reflector or preferably used as the light source for a larger optical system to provide the desired lighting characteristics. In particular, typical LEDs, even with reflectors, do not have enough light output and do not provide a sufficiently narrow beam to produce a highly collimated beam of the desired intensity. An optical system that includes the present invention light source structure and an optical homogenizer can provide a highly collimated, intense beam of light of substantially any color with excellent mixing of individual colors by the homogenizer.

The LEDs may be driven in a pulse width modulated manner to provide the desired color or combination of colors and brightness so that a substantially full color gamut may be achieved under program control by a central controller. Alternatively, the LEDs may be driven individually so that any number of LEDs of any color may be turned on at any time to provide the desired color mixing to achieve the desired color gamut. Individual control has the further advantages of grossly reducing the on-off switching of the LEDs, and also allows alternating the LEDs that are turned on (such as by a circuit or program which randomly or pseudo randomly selects which LEDs shall first be turned on, which second, and so forth) when less than the full intensity of that color is needed, thereby allowing equalizing of the cumulative ON time of all LEDs of each color to minimize unequal aging or color drift of the LEDs. Of course other schemes for intensity and color control may be used, as desired.

Any reflector, if used may be vented to allow cooling water to flow around the sides of the lighting module and then up by convection cooling, either or both by vents in the reflector, such as at the bottom of the reflector, and by spacing the lighting module away from the reflector to provide a water flow path to promote convection cooling.

The present invention has been disclosed with respect to underwater lighting. However the invention is not so limited, and may be used for other purposes, such as by way of example, for theatrical lighting, as use of the present invention with a light homogenizer eliminates the multi-shadowing otherwise seen in all other LED lights due to their multiple LED light sources. Thus the superior optics of both the white and color versions lighting of the present invention are attractive for numerous air cooled uses, whether using the same number or fewer (or more LEDs), or LEDs of lower (or possibly higher) wattage, or by driving the LEDs at reduced currents. Such versions may be cooled, as necessary, with fans, with or without shrouds around the LED assemblies for directed air flow. In that regard, the LED supports 34, 36, 38, 40, 42, 44, 46 and 48 act as cooling fins for the LED assembly, and may be extended outward, if desired, to increase the area thereof that is exposed to the airflow.

The LED supports have been described herein with respect to two embodiments using plates for the purpose. I should be noted that any tiered construction for the LED supports may be used as desired, provided the LEDs on the lower LED supports can project light through the openings of the LED supports there above, and effectively appear to essentially fully populate the emitting area of the lighting module as viewed from above.

Thus the present invention has a number of aspects, which aspects may be practiced alone or in various combinations or sub-combinations, as desired. While preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. A lighting module comprising: a first LED support having an outer edge and an inner opening, the first LED support having a first plurality of LEDs mounted thereon adjacent the inner opening in the first LED support; a second LED support having an outer edge and an inner opening, the second LED support having a second plurality of LEDs mounted thereon adjacent and circumscribing the inner opening of the second LED support; the second LED support being connected and spaced apart from the first LED support by a spacer that helps seal the lighting module from an air or a water environment; wherein at least one of the outer edges of the first and second LED support is exposed to the air or water environment; the inner opening of the first LED support being larger than the region of the second LED support circumscribed by the second plurality of LEDs on the second LED support; whereby light from the LEDs on the second LED support may pass though the inner opening of the first LED support.

2. The lighting module of claim 1 wherein the outer edge of the first LED support extends outward beyond the outer edge of the second LED support, whereby at least part of one surface of the first LED support is exposed to the environment for cooling.

3. The lighting module of claim 1 further comprising a third LED support, the third LED support having an outer edge and an inner opening, the third LED support having a third plurality of LEDs mounted thereon adjacent and circumscribing the inner opening of the third LED support;

the third LED support being connected to and spaced apart from the second LED support by a second spacer that helps seal the lighting module from the environment;

the inner opening of the second LED support being larger than the region of the third LED support circumscribed by the third plurality of LEDs on the third LED support;

whereby light from the LEDs on the third LED support may pass though the inner openings of the second and first LED supports.

4. The lighting module of claim 3 wherein at least the outer edge of the first LED support extends outwardly beyond the connection between the first and second LED supports, and wherein the outer edge of the second LED support extends outwardly beyond the connection between the second and third LED supports, whereby the first through third LED supports may be part of a larger sealed assembly for submersion in water, with at least one surface of the first and second LED supports adjacent their outer edges will be exposed to the water to increase the cooling of the LED supports and the LEDs thereon.

5. The lighting module of claim 3 wherein the outer edge of the first LED support extends beyond the outer edge of the second LED support and the connection between the first and second LED supports, and the outer edge of the second LED support extends beyond the outer edge of the third LED support and the connection between the second and third LED supports, whereby at least an area of one surface of the first and second LED supports adjacent their outer edge is exposed for cooling.

6. The lighting module of claim 5 further comprising a fourth LED support, the fourth LED support having an outer edge and an inner opening, the fourth LED support having a fourth plurality of LEDs mounted thereon adjacent and circumscribing the inner opening of the fourth LED support, the fourth LED support being connected to and spaced apart from the third LED support by a third spacer that helps seal the lighting module from the environment;

the inner opening of the third LED support being larger than the region of the fourth LED support circumscribed by the fourth plurality of LEDs on the fourth LED support;

whereby light from the LEDs on the fourth LED support may pass though the inner openings of the third, second and first LED supports.

7. The lighting module of claim 6 further comprised of a fifth LED support, the fifth LED support having a fifth plurality of LEDs mounted thereon adjacent a center of the fifth LED support;

the fifth LED support being connected to and spaced apart from the fourth LED support by a fourth spacer that helps seal the lighting module from the environment;

the inner opening of the fourth LED support being larger than the area of the fifth LED support having the fifth plurality of the LEDs thereon;

whereby light from the LEDs on the fifth LED support may pass though the inner openings of the fourth, third, second and first LED supports.

8. The lighting module of claim 7 wherein at least the second LED support extends outwardly beyond the connection of the first and second LED supports and extends outwardly beyond connection of the second and third LED supports, and wherein the outer edge of the third LED support extends outwardly beyond the outer edge of the fourth LED support and the outer edge of the fourth LED support extends outwardly beyond the outer edge of the fifth LED support, and wherein the first, second, third and fourth spacers are sealed connections, whereby the first through fifth LED supports may be part of a larger sealed assembly for submersion in water, with both respective surfaces of the part of the second LED support that extends outwardly beyond the connection of the first and second LED supports and the connection of the second and third LED supports will be disposed in water, and at least one surface of the first, third, fourth and fifth LED supports adjacent their outer edges will be exposed to the water to increase the cooling of the LED supports and the LEDs thereon.

9. The lighting module of claim 8 wherein the connections between adjacent LED supports are metal annular spacers.

10. The lighting module of claim 3 wherein the inner openings and outer edges of the LED supports are circular.

11. The lighting module of claim 10 wherein the LEDs on each LED support are arranged in a circle.

12. The lighting module of claim 10 wherein the LEDs on each LED support are arranged in a circle having a radial extent of one LED.

13. The lighting module of claim 1 wherein the LEDs are mounted on each respective LED support by being electrically mounted on a circuit board on each respective LED support.

14. The lighting module of claim 13 wherein the LED supports are each metal LED supports, and wherein the LEDs have first and second electrical contacts and a thermal pad, the thermal pad being mounted on the respective LED support and the first and second electrical contacts being mounted on the respective circuit board.

15. A lighting module comprising: a first LED support having a first plurality of LEDs mounted thereon adjacent a center of the first LED support; a second LED support having an outer edge and an inner opening, the second LED support having a second plurality of LEDs mounted thereon adjacent and circumscribing the inner opening of the second LED support; the second LED support being connected to and spaced apart from the first LED support by a spacer that helps seal the lighting module from an air or a water environment; wherein at least one of the first LED support and the second LED support is exposed to the air or water environment; the inner opening of the second LED support being larger than the region of the first LED support circumscribed by the first plurality of LEDs on the first LED support; whereby light from the LEDs on the first LED support may pass though the inner opening of the second LED support.

16. The lighting module of claim 15 further comprising a third LED support, the third LED support having an outer edge and an inner opening, the third LED support having a third plurality of LEDs mounted thereon adjacent and circumscribing the inner opening of the third LED support;

the third LED support being connected to and spaced apart from the second LED support by a second spacer that helps seal the lighting module from an environment;

wherein at least one of the second LED support and the third LED support is exposed to the environment;

the inner opening of the third LED support being larger than the region of the second LED support circumscribed by the second plurality of LEDs on the second LED support;

whereby light from the LEDs on the first and second LED supports may pass though the inner opening of the third LED support.

17. The lighting module of claim 16 wherein the LED supports are circular.

18. The lighting module of claim 17 wherein the LEDs on each LED support are disposed in a respective circle.

19. The lighting module of claim 17 wherein the LEDs on the second and third LED supports are disposed in a respective circle having a radial extent of one LED.

20. The lighting module of claim 19 wherein the LED supports are each metal LED supports, and wherein the LEDs have first and second electrical contacts and a thermal pad, the thermal pad being mounted on the respective LED support and the first and second electrical contacts being mounted on the respective circuit board.

21. The lighting module of claim 17 wherein the LEDs are mounted on the first, second, third and fourth LED supports by being mounted on a circuit board on each respective LED support.

22. The lighting module of claim 15 wherein at least the outer edge of the second LED support extends outwardly beyond the connection between the first and second LED supports, and wherein the outer edge of the third LED support extends outwardly beyond the connection between the second and third LED supports, whereby the first through third LED supports may be part of a larger sealed assembly for submersion in water, with at least one surface of the first and second LED supports adjacent their outer edges will be exposed to the water to increase the cooling of the LED supports and the LEDs thereon.

23. A lighting module comprising: a tiered group of LED supports, each having an opening therein; each LED support supporting a plurality of LEDs surrounding the respective opening and facing a first direction; a second of the LED supports being spaced away from and connected to the first LED support in the first direction by a spacer that helps seal the lighting module from an air or a water environment; wherein at least one of the first LED support and the second LED support is exposed to the air or water environment; the opening in the second LED support allowing light from the LEDs supported by the first LED support to pass there through; the lighting module when viewed along a second direction opposite the first direction appearing to have the LEDs on the first LED support surrounded by the LEDs on the second LED support.

24. The lighting module of claim 23 further comprising:

a bottom LED support spaced from the first LED support in the second direction;

a central region of the bottom LED support having a plurality of LEDs thereon;

the opening in the first LED support allowing light from the LEDs supported by the bottom LED support to pass there through;

the lighting module when viewed along the second direction appearing to have the LEDs on the bottom LED support surrounded by the LEDs on the first LED support, in turn surrounded by the LEDs on the second LED support.

* * * * *